US005297750A

United States Patent [19]

Hunt

[11] Patent Number: 5,297,750

[45] Date of Patent: Mar. 29, 1994

[54] HOLDER FOR ROLLS OF MATERIAL

[76] Inventor: Jack E. Hunt, 3103 Tanglebriar, Pasadena, Tex. 77503

[21] Appl. No.: 991,396

[22] Filed: Dec. 16, 1992

[51] Int. Cl.[5] ..... A47K 10/22; B65H 23/08

[52] U.S. Cl. ..... 242/55.54; 242/75.4; 242/129.8

[58] Field of Search ..... 242/55.2, 55.3, 55.42, 242/55.54, 75.4, 129.7, 129.71, 129.8, 139, 99

[56] References Cited

U.S. PATENT DOCUMENTS

| | | | |
|---|---|---|---|
| 899,461 | 9/1908 | McNeil | 242/55.2 |
| 2,707,595 | 5/1955 | Brown | 242/55.2 |
| 3,539,124 | 11/1970 | Belokin, Jr. | 242/55.54 |
| 3,620,465 | 11/1971 | Wyatt | 242/55.2 |
| 4,273,299 | 6/1981 | Ness | 242/55.2 |
| 4,373,682 | 2/1983 | Dickson | 242/55.2 |
| 5,170,956 | 12/1992 | McTaggart | 242/55.2 |

FOREIGN PATENT DOCUMENTS

| | | | |
|---|---|---|---|
| 216096 | 9/1957 | Australia | 242/55.2 |

*Primary Examiner*—Daniel P. Stodola
*Assistant Examiner*—John Q. Nguyen
*Attorney, Agent, or Firm*—Kenneth A. Keeling

[57] ABSTRACT

An apparatus for receiving a roll of detachable material including an inner post having a suitable diameter for receiving the roll and a suitable mounting device affixed to at least one end of the inner post. The inner post has a first friction member which extends resiliently outwardly beyond the diameter of the inner post so as to exert a friction force against an inner surface of the roll. The mounting device is suitable for positioning this inner post on a surface. An alternative embodiment includes an outer post slidably received over the diameter of the inner post, the inner post having a second friction member which extends resiliently outwardly of the inner post so as to exert a friction force against an inner surface of the outer post. A mounting member includes a base which is affixed to an end of the inner post so as to allow the inner post to extend perpendicularly relative to the base.

8 Claims, 3 Drawing Sheets

HOLDER FOR ROLLS OF MATERIAL

FIELD OF INVENTION

The present invention relates to an apparatus for receiving rolls of material, such as paper towels, toilet tissue, plastic bags, and related items. More particularly, the present invention relates to a holder apparatus which prevents unnecessary unrolling of such material.

BACKGROUND OF THE INVENTION

It is a common problem in the prior art that paper towel dispensers will freely dispense paper towels in an unrestricted fashion. As such, the situation often presents itself where many items are unrolled by accident. Typically, in order to prevent the unnecessary unrolling of material, the user must operate the paper towel dispensing apparatus with two hands.

Various patents have been issued in the past concerning braking devices for paper towel holders and for rolled paper dispensers. Compton U.S. Pat. No. 4,487,376 describes a support for a conventional roll of perforated paper toweling having a base for mounting on a vertical or horizontal surface, a support rod perpendicular to the base for holding the towel roll, and a manually operable braking device for impeding the unrolling of the towels when one is being torn off the roll. When the braking device is pushed down with one hand, the roll is held steady for removal of a paper towel with the other hand. Two hands are required for the operation of this device.

Vance U.S. Pat. No. 4,720,053 discloses a holder for a roll of paper which has a base shaped to prevent tipping over and which is provided with an upstanding pole for holding a roll of paper in place between a cap and a base. Upstanding parallel spaced guides guide the sheet of paper for removal. Impeding material is placed on the base and pole so as to impede the removal of the sheets. The holder is not anchored so as to prevent tilting over when the item is removed.

Olson U.S. Pat. No. 4,792,102 discloses a paper towel dispensing apparatus which includes a base and an upright rod attached thereto. The roll is installed on the rod with the rod positioned within the hollow interior of the roll. A brake support structure is attached to the base which is spaced from the rod so as to permit a roll of paper towels to be installed on the rod. A releasable attaching means attaches the brake to the rod so as to secure the brake in a braking position. The brake defines an underside surface which frictionally engages an end of the roll when the brake is in the braking position. The frictional engagement stops the roll from rotating and unrolling after a paper towel has been torn from the roll.

Gains et al. U.S. Pat. No. 4,807,824 discloses a paper roll towel dispenser having a primary roll and a reserve roll of paper toweling. As the primary roll becomes depleted, the counterbalancing force of the roll decreases, thereby causing a tucking element to gradually approach the leading end of the reserve roll until the element finally engages the end of the roll. A damper mechanism is provided so as to prevent premature introduction of the leading end.

Bastian U.S. Pat. No. 4,915,316 discloses a paper roll holder which has a back bar adapted to be mounted to a surface. The bracket has a journal that can extend into a core of the paper roll for supporting the towel roll. Spring tension is provided on each side to hold the towels on the holder as well as to give some braking action to the paper towel roll.

It is an object of the present invention to provide a paper towel holder which effectively prevents too many sheets from being dispensed.

It is another object of the present invention to provide a paper towel holder that is adaptable for horizontal and vertical operation.

It is another object of the present invention to provide a paper towel holder which is relatively easy to use and simple to install.

These and other objects and advantages of the present invention will become apparent from reading the attached specification and appended claims.

SUMMARY OF THE INVENTION

The present invention is an apparatus for receiving a roll of detachable towels which includes a cylindrical inner post and a mounting member non-rotatably affixed to one end of the inner post. The inner post has a suitable diameter for receiving the roll of towels. A first friction member extends resiliently outwardly from the inner post beyond the diameter of the inner post. This friction member serves to exert a friction force against an interior surface of the roll. The mounting member enables the inner post to be positioned on a surface, such as a counter, a table, or between a counter and cabinets above.

The friction member includes a first arm which is pivotally connected to the inner post, and a spring which is connected to the first arm so as to urge the first arm outwardly from the inner post. A second arm is pivotally connected to the inner post on the opposite side of the inner post from the first arm. The spring extends between the first and second arms so as to resiliently urge the arms outwardly.

In an embodiment, an outer post is slidably received over the diameter of the inner post. The inner post includes a second friction member which extends resiliently outwardly of the inner post. The second friction member serves to exert a friction force against the inner surface of the outer post. This second friction member serves to fix the position of the outer post with respect to the mounting member. The second friction means includes a first abutment member having a surface in resilient abutment with the inner surface of the outer post. A second abutment member also has a surface in resilient contact with the outer post. A compression spring extends between these abutment members within the inner post. The compression spring urges the first and second abutment members outwardly of the inner post.

The inner post extends perpendicularly to the mounting member. The outer post has a cylindrical inner surface extending over the outer diameter of the inner post. The outer post is movable between a first position abutting the mounting member and a second position removed from the mounting member. The outer post extends over the first friction member when in the first position. The first friction member extends outwardly beyond the outer diameter of the outer post when the outer post is in the second position.

In an alternative embodiment of the present invention, the first friction member is a leaf spring having one end affixed to the inner post and having an opposite end extending resiliently outwardly of the inner post. In an alternative embodiment, the second friction member also comprises a leaf spring having one end affixed to a surface of the inner post and another end extending outwardly of the inner post for exerting a friction force on the outer post.

In an alternative embodiment of the present invention, the mounting member is a holder suitable for vertical and/or horizontal receipt of the inner post only.

BRIEF DESCRIPTION OF THE DRAWINGS

FIG. 16 is a cross-sectional view of another alternative embodiment of the present invention.

DETAILED DESCRIPTION OF THE INVENTION

Figure 1:
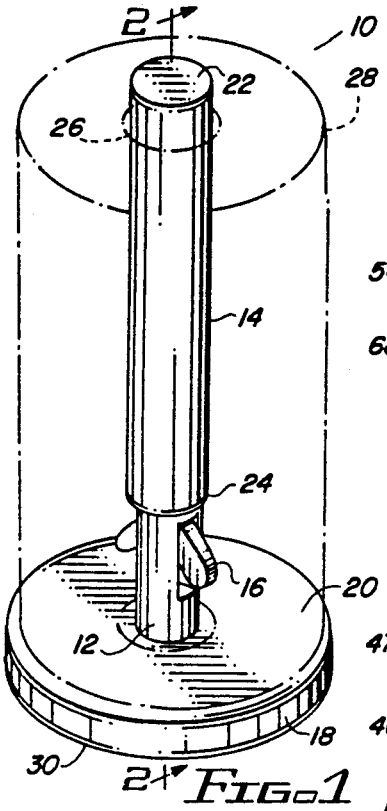
FIG. 1 is an isometric view showing the preferred embodiment of the present invention holding a roll of paper towels thereon.

In FIG. 1, there is shown at 10 the improved paper towel holder in accordance with the preferred embodiment of the present invention. As can be seen in FIG. 1, the paper towel holder 10 includes a cylindrical inner post 12, an outer post 14, a resilient friction member 16, and a mounting member 18. Specifically, the inner post 12 is affixed to the mounting member 18 so that the inner post 12 extends vertically upwardly from the top surface 20 of the mounting member 18. The mounting member 18 is positioned in generally perpendicular relationship to the inner post 12. The outer post 14 is a hollow cylinder which extends over the outer diameter of the cylindrical inner post 12.

The outer post 14, as shown in FIG. 1, is in a raised position. The outer post 14 includes a closed end 22 and an open end 24. The closed end 22 is provided with an external surface resistant to slippage or skidding. A suitable surface may be provided by a rubber or rubber like coating or by providing a textured exterior surface. The open end 24 extends around the outer diameter of the inner post 12. The outer post 14 is specifically configured so as to extend through the inner diameter 26 of a roll of paper towels 28 (or other detachable rolled material). When the present invention is installed on a counter top and beneath a set of cabinets, the non-skid closed end 22 of the outer post 14 will abut the underside of the cabinets while the bottom surface 30 of the mounting member 18 rests against the surface of the counter (not shown).

Still referring to FIG. 1, the first friction member 16 is shown extending outwardly from the outer diameter of the inner post 12, generally near the top surface 20 of the mounting member 18. The first friction member 16 extends outwardly for frictional engagement with the inner diameter 26 of roll 28.

As can be seen in FIG. 1, the roll 28 extends around the outer diameter of outer post 14 and around the outer diameter of inner post 12. Friction member 16 exerts a resilient force against the inner diameter 26 of the roll 28 to prevent undesired unrolling of the material (not shown) from roll 28. An end of roll 28 is supported by the top surface 20 of mounting member 18. The mounting member 18 includes a generally flat top surface 20 and a bottom surface 30. Bottom surface 30 is resistant to skidding. A suitable surface may be provided by a rubber or rubberized coating or by providing a textured surface. Additionally, suction cups or other attachment means may be provided. The bottom surface 30 of the mounting member 18 may exert sufficient frictional engagement forces against the counter so as to allow the device to be operated without further attachment to the counter.

Figure 2:
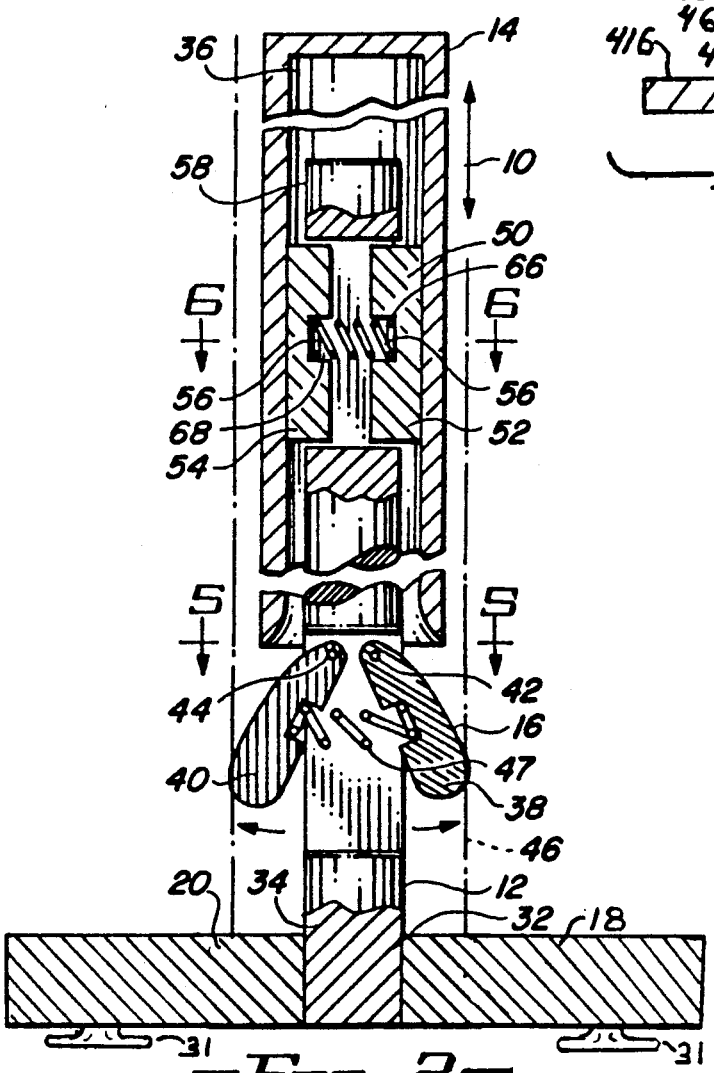
FIG. 2 is a cross-sectional view at lines 2—2 of FIG. 1.

FIG. 2 shows a cross-sectional view of the apparatus 10 of the present invention. FIG. 2 depicts the relative arrangement of the inner post 12, the outer post 14, and the mounting member 18. Specifically, the inner post 12 is fixedly received in an aperture 32 provided within the mounting member 18. The end 34 of the inner post 12 may be fastened to the mounting member 18 by suitable means including adhesives, doweling, or fasteners. The inner post 12 is non-rotatably fastened to the mounting member 18.

Cylindrical interior 36 of outer post 14 extends around the outer diameter of the inner post 12. The outer post 14 is in slidable relationship with the inner post 12. In the configuration illustrated in FIG. 2, the outer post 14 is in its upper position, removed from the mounting member 18.

Still referring to FIG. 2, friction member 16 comprises a first arm 38 and a second arm 40. First arm 38 is pivotally connected at first connection 42 to the inner post 12. Similarly, second arm 40 is pivotally connected at second connection 44 to the inner post 12. First connection 42 and second connection 44 allow the first arm 38 and second arm 40 to extend outwardly from inner post 12. Spring 47 extends between the first arm 38 and second arm 40 so as to bias first arm 38 and second arm 40 outwardly into frictional engagement with the inner surface (not shown) of the roll of paper towels. The roll of paper towels is illustrated in broken line fashion at 46 in FIG. 2.

Referring to FIG. 2, a second friction member 50 is provided on inner post 12. Second friction member 50 includes a first abutment member 52 and a second abutment member 54. Each of the first abutment member 52 and the second abutment member 54 includes a surface which is in resilient contact with the inner surface of the outer post 14. This arrangement serves to assure that the outer post 14 resides in its proper position relative to the mounting member 18. In this manner, the outer post 14 can be properly adjusted so as to fit in the area between counter tops and cabinets. The abutment members 52 and 54 have a compression spring 56 extending therebetween. The compression spring 56 extends within the inner post 12 so as to urge the first and second abutment members outwardly from the inner post 12. Opening 68 is provided in abutment member 52 and opening 66 is provided in abutment member 52 to receive spring 56. The first and second abutment members 52 and 54 are received within an open area formed within the interior of the inner post 12. The inner post 12 terminates at 58 above the abutment members 52 and 54.

FIG. 2 further discloses attachment means for removable attachment of the apparatus 10 to a surface (not shown). The attachment means disclosed in FIG. 2 comprise suction cups 31. Other attachment means may be provided to attach or releasably attach the apparatus 10 to a surface.

Figure 3:
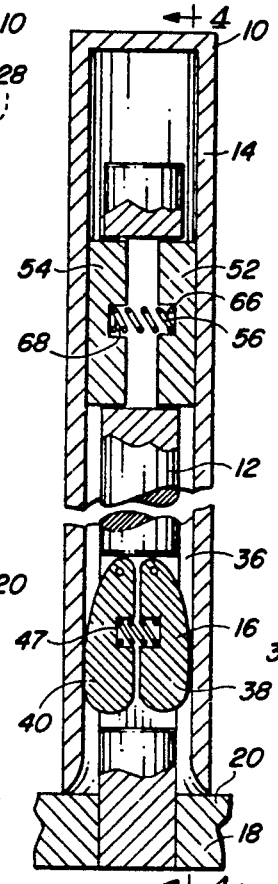
FIG. 3 is a cross-sectional view of the apparatus of the present invention with the outer post in its lowermost position.

FIG. 3 illustrates the configuration of the preferred embodiment 10 of the present invention in which the outer post 14 is lowered to its lowermost position over the inner post 12. In the configuration shown in FIG. 3, the outer post 14 resides in juxtaposition with the top surface 20 of the mounting member 18. When the outer post 14 is in this position, the first friction member 16 is in its fully retracted position within the interior of the inner post 12. The spring 47 is suitably compressed. The first arm 38 and the second arm 40 are drawn together within the interior of inner post 12. In this arrangement, the outer surfaces of the arms 38 and 40 will continue to exert a friction force on the inner surface 36 of the outer post 14. In this arrangement, the abutment members 52 and 54 will continue to exert resilient friction forces against the inner surface 36 of the outer post 14.

In the arrangement shown in FIG. 3, a roll of paper towels can be placed over the outer diameter of the outer post 14. Since the first friction member 16 is in its fully retracted position within the interior of the outer post 14, the first friction member 16 is not in a proper position to exert friction forces against the inner diameter 26 of the roll 28. In this position, the roll 28 (not shown in FIG. 3) is free to rotate freely (as on conventional holders). In order to impart friction forces to the interior of the roll 28, it is only necessary to raise the outer post 14 so as to expose the first friction member 16 and to allow the arms 38 and 40 to come into surface-to-surface resilient contact with the inner diameter of the roll 28 (not shown in FIURE 3).

Figure 4:
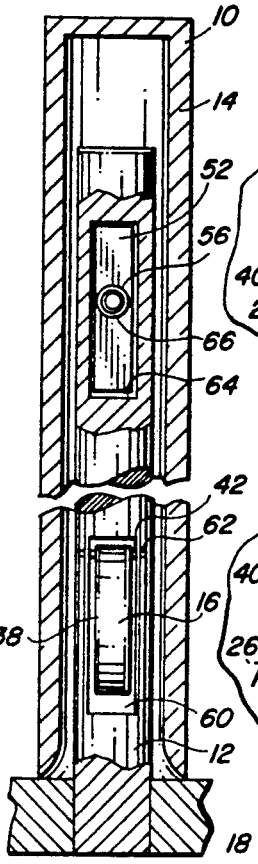
FIG. 4 is a cross-sectional view at lines 4—4 of FIG. 3.

FIG. 4 shows how the first friction member 16 is positioned within the interior of the inner post 12. The first arm 38 is in its fully retracted position within slot 60 of the inner post 12. A pin 62 extends through the first connection 42 of the first arm 38 and is received within the interior of the inner post 12. In this manner, the arm 38 is free to pivot with respect to the pin 62. The slot 60 has a suitable size so as to allow for the full range of movement of the arm 38 between its retracted and its extended position.

FIG. 4 also shows how the first abutment member 52 is received within a rectangular slot 64 on the interior of the inner post 12. Since there is no angular displacement of the first abutment member 52, the rectangular slot 64 has a size generally conforming to the perimeter of the rectangular first abutment member 52. The first abutment member 52 includes a suitable opening 66 for the purpose of accommodating the compression spring 56. The first abutment member 52 is free to move inwardly and outwardly relative to the slot 64 for the purpose of engaging the inner surface of the outer post 14.

Figure 5:
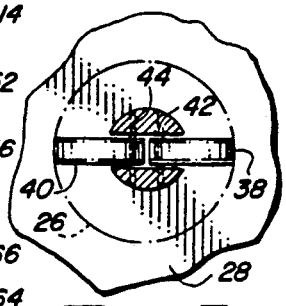
FIG. 5 is a cross-sectional view at lines 5—5 of FIG. 2.

FIG. 5 shows the manner in which the arms 38 and 40 pivot about the connections 42 and 44. In particular, the connections 42 and 44 extend across the diameter of the inner post 12. The arms 38 and 40 extend outwardly so as to engage the inner diameter 26 of a roll of towels 28. In this arrangement, the outer surfaces of the arms 38 and 40 are in frictional contact with the inner diameter 26 of roll 28. It can be seen that the inner post 12 is concentric with the inner diameter 26 of roll 28.

Figure 6:
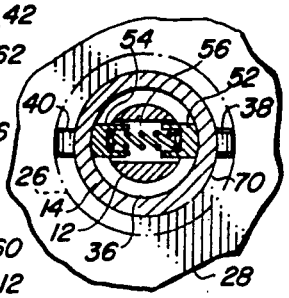
FIG. 6 is a cross-sectional view at lines 6—6 of FIG. 2.

In FIG. 6, the abutment members 52 and 54 are illustrated. The compression spring 56 is shown as extending between the abutment members 52 and 54. The abutment member 52 extends outwardly of the inner post 12 so as to engage the inner surface 36 of the outer post 14. Similarly, the abutment member 54 extends outwardly from the inner post 12 so as to engage the inner surface 36 of the outer post 14. The frictional engagement between the abutment members 52 and 54 and the inner surface 36 suitably prevent free movement of the outer post with respect to the inner post. In FIG. 6, it can be seen that the arms 38 and 40 extend outwardly beyond the outer diameter 70 of the outer post 14 so as to engage the inner diameter 26 of roll 28.

Figure 7:
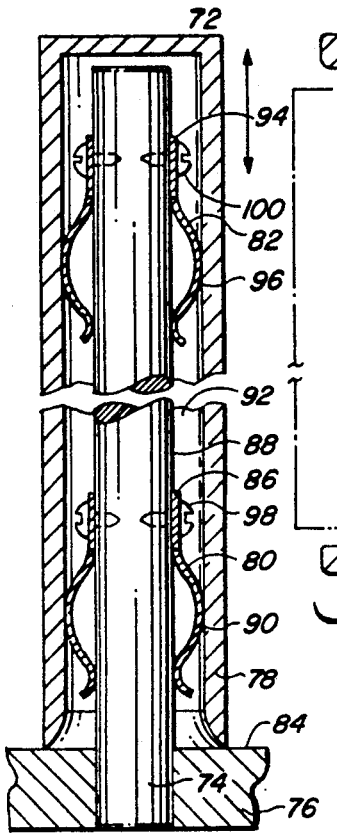
FIG. 7 is a cross-sectional view of an alternative embodiment of the apparatus of the present invention showing the outer post in a lowered position.

In FIG. 7, there is shown at 72, an alternative embodiment of the apparatus of the present invention. Specifically, in this alternative embodiment of the present invention, the inner post 74 is received within the base 76 so as to extend upwardly perpendicularly thereto. The outer post 78 extends over the inner post 74 in the manner previously described herein. The important difference in the embodiment of FIG. 7 is the use of leaf springs 80 as the first friction member and the use of leaf springs 82 as the second friction member. It can be seen that the leaf springs 80 are positioned generally adjacent to the top surface 84 of the base 76. The leaf springs 80 have a first portion 86 affixed to the outer post 88 of the inner post 74. The leaf spring 80 has another portion 90 which extends resiliently outwardly from the fixed end 86. Portion 90 will be in frictional abutment with the inner surface 92 of the outer post 78. In general, the configuration of the leaf spring 80 will serve the purposes as described in conjunction with the first friction member of FIGS. 1–6.

The second friction member 82 is also a leaf spring which has one end 94 affixed to the outer surface 88 of the inner post 74. The leaf spring 82 includes a portion 96 which extends outwardly from the fixed end 94 so as to be in frictional contact with the inner surface 92 of the outer post 78. The leaf spring 82 acts in frictional engagement with the inner surface 92 of the outer post 78 so as to affix the position of the outer post 78 with respect to the base 76. In FIG. 7, screws 98 serve to affix the leaf spring 80 to the outer surface of the inner post 74. Screws 100 are used to affix the end 94 of leaf spring 82 to the inner post 74.

Figure 8:
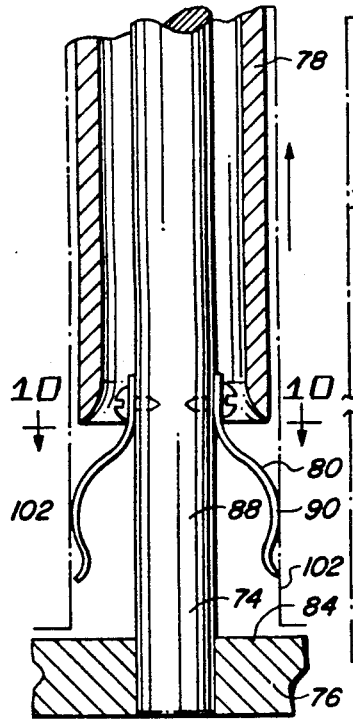
FIG. 8 is a cross-sectional view of the alternative embodiment of FIG. 7 showing the outer post in a raised position.

In FIG. 8, it can be seen that the first leaf spring 80 will extend outwardly from the outer surface 88 of the inner post 74 when the outer post 78 is raised upwardly. The resilient nature of the leaf spring 80 will cause its outer portion 90 to extend outwardly from the inner post 74. The leaf spring 80 will extend outwardly so as to be in frictional contact with the inner diameter 102 of a roll of paper towels (as illustrated in broken line fashion in FIG. 8). This frictional contact will prevent unwanted unrolling of the paper towel. In this position, the upper leaf spring 82 (not shown in FIG. 8) will serve to retain the outer post 78 in its position above the top surface 84 of mounting member 76.

Figure 9:
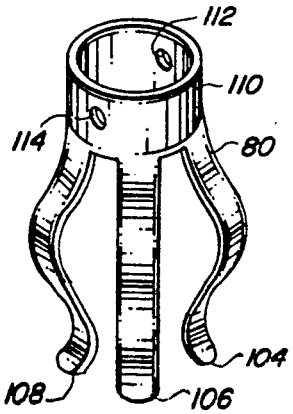
FIG. 9 is an isometric view of the leaf spring as used in the alternative embodiment of FIG. 7.

FIG. 9 is an isolated illustration of leaf spring 80. FIG. 9 also illustrates the leaf spring 82. Leaf spring 80 has a plurality of resilient arms 104, 106, and 108. The upper ring 110 of leaf spring 80 has a pair of holes 112 and 114. Holes 112 and 114 suitably receive the screws, as previously described herein. The arms 104, 106, and 108 are properly manufactured so as to be tensioned and to extend outwardly from the ring 110 under uncompressed conditions.

Figure 10:
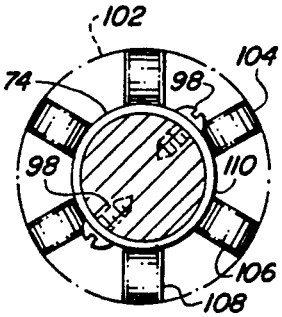
FIG. 10 is a cross-sectional view at lines 10—10 of FIG. 8.
Figure 1B:
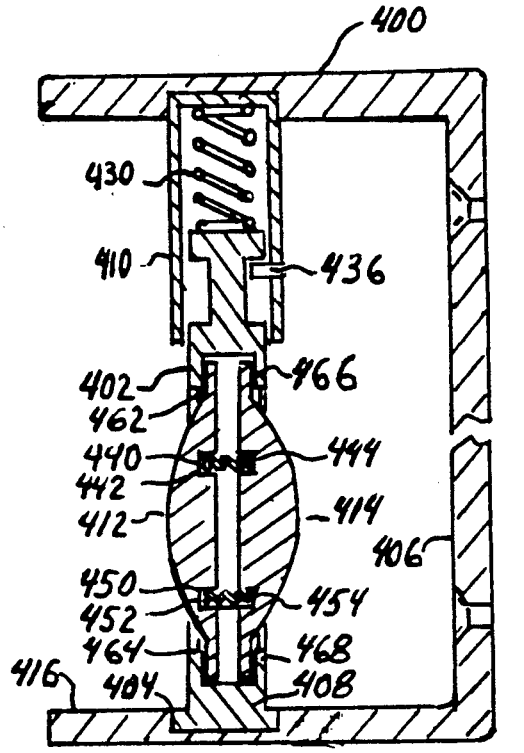

In FIG. 10, it can be seen how the leaf spring 80 has its arms 104, 106 and 108 extending outwardly therefrom. The ring 110 is fastened by screws 98 to the inner post 74. The outwardly extending arms engage the inner surface 102 of a roll of paper towels.

Figure 11:
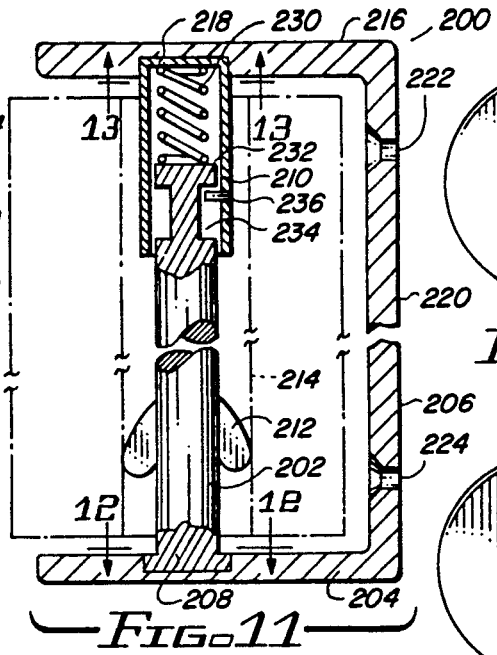
FIG. 11 is a cross-sectional view of another alternative embodiment of the apparatus of the present invention.

FIG. 11 shows another alternative embodiment 200 of the present invention. In the embodiment 200, it can be seen that the inner post 202 is removably affixed to a first area 204 on a holder 206 The end 208 is received by area 204 such that the inner post 202 extends generally perpendicular to the surface 204. The outer post 210 extends around the outer diameter of the inner post 202. The first friction member 212 extends outwardly from the inner post 202 in the manner previously described herein. The first friction member 212 engages the inner diameter 214 of a roll of paper towels (or toilet tissue), as illustrated in broken line fashion in FIG. 11. The outer post 210 is received by a second area 216 of the holder 206. The end 218 of the outer post 210 is demountably received within an indentation formed within the inner surface of area 216. A longitudinal side 220 extends between first area 204 and second area 216. First area 206 is maintained in generally parallel relationship with area 216. The posts 202 and 210 extend perpendicularly therebetween. The longitudinal side 220 includes openings 222 and 224 for the receipt of screws for fastening longitudinal side 220 to an exterior surface.

In the embodiment shown in FIG. 11, it can be seen that the spring 230 is interposed between the top closed end 218 of outer post 210 and the top surface 232 of the inner post 202. Spring 230 is a compression spring which urges the outer post 210 away from the top surface 232 of the inner post 202. The inner post 202 has a guide area 234 formed therein. Guide area 234 is designed to restrict the travel of the outer post 210 with respect to the inner post 202. A guide pin 236 extends through the outer post 210 and is received within the guide area 234. In this manner, the guide area 234 acts as a stop, or limit, to the travel of the post 210. The indented area of the side 216 of holder 206 further serves to limit the travel of the outer post 210 with respect to inner post 202.

In order to remove the posts 202 and 210 from the interior of the holder 206, it is only necessary for the user to compress the outer post 210 toward the end 232 of the inner post 202. The end 208 can be pulled from the opening in the area 204 so that the entire apparatus can be removed.

Figure 12:
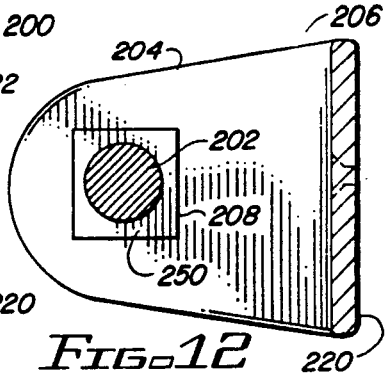
FIG. 12 is a view at lines 12—12 of FIG. 11.

FIG. 12 illustrates the configuration of the first area 204 of the holder 206. This first area 204 includes a non-circular rectangular receiving area 208 for the receipt, in removable fashion, of the end of the inner post 202. Inner post 202 has a rectangular end 250 which can be received within the rectangular opening 208. The receipt of the rectangular end 250 within area 208 assures the non-rotatable connection between the inner post 202 and the area 204. Longitudinal side 220 extends from this area 204.

Figure 13:
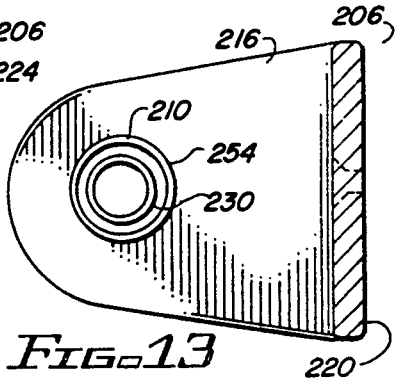
FIG. 13 is a view at lines 13—13 of FIG. 11.

FIG. 13 illustrates the second area 216 of the holder 206. Specifically, it can be seen that the second area 216 includes a circular receiving area 254 for the receipt of the end 218 (not shown in FIG. 13) of the outer post 210. Spring 230 extends interior of the outer post 210. Longitudinal side 220 extends perpendicular to area 216.

Figure 14:
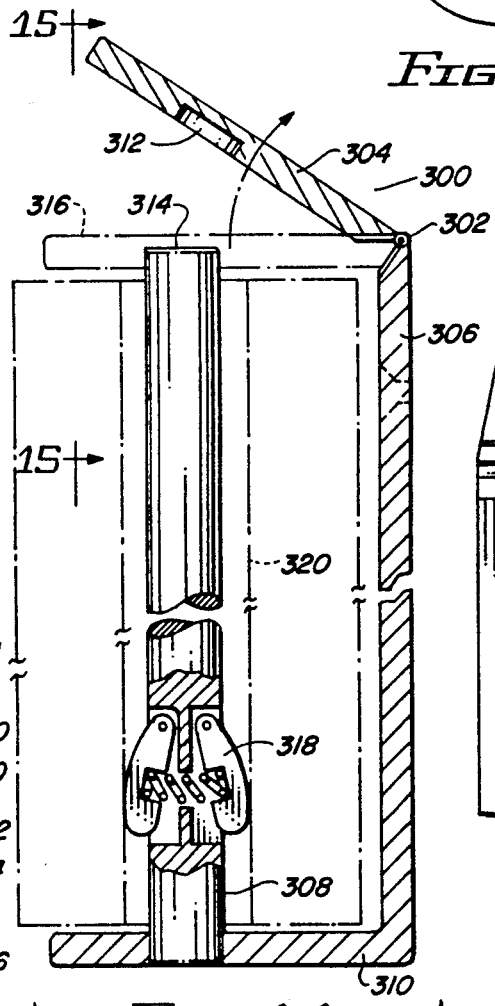
FIG. 14 is a cross-sectional view of another alternative embodiment of the present invention.

FIG. 14 shows another embodiment 300 of the present invention. The embodiment 300 resembles the embodiment shown in FIG. 11 in several respects. Importantly, the major difference between the embodiment 300 and that of the embodiment shown in FIG. 11 is the use of the spring loaded hinge 302 for fastening area 304 to the longitudinal side 306. The inner post 308 is fixedly fastened to the area 310 of the holder 306. In this arrangement, the inner post 308 extends between the area 304 and the area 310. The area 304 includes a receiving area 312 for extending around the outer diameter of the inner post 308 adjacent to the end 314. This manner of joining the area 304 to the end 314 of inner post 308 is illustrated in broken line fashion at 316 in FIG. 14.

In the embodiment shown in FIG. 14, the outer post is not used. Specifically, the first friction member 318 extends outwardly so as to engage the inner diameter 320 of a roll of paper towels or toilet tissue. In this manner, suitable friction is exerted against the roll so as to prevent unwanted unrolling. When it is desired to remove the roll, the area 304 is rotated about hinge 302 so as to expose the end 314 of post 308. In this manner, the roll 320 can be removed and a new roll inserted therein.

Figure 15:
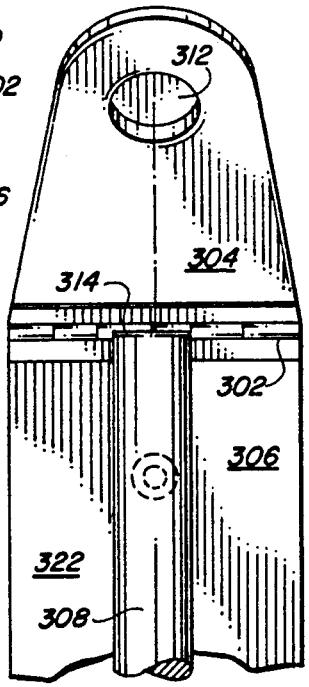
FIG. 15 is a view at lines 15—15 of FIG. 14.

FIG. 15 specifically shows the manner in which the area 304 is connected at hinge 302 to the holder 306. The receiving area 312 has a generally circular configuration for mating with the end 314 of the post 308. The holder 306 includes the longitudinal side 322 which extends between the first area 304 and the second area 310.

FIG. 16 shows another alternative embodiment 400 of the present invention. The inner post 402 is removably affixed to a first area 404 of surface 416 of holder 406. The end 408 is received by area 404 such that the inner post 402 extends generally perpendicularly to the surface 416. The outer post 410 extends around the diameter of the inner post 402. First friction member 412 extends outwardly from the inner post 402. Second friction member 414 extends outwardly from the inner post 402 in the direction opposite first friction member 412.

First spring 440 extends between first friction member 412 and second friction member 414. Aperture 442 is provided in first friction member 412 for receiving an end of first spring 440. Aperture 444 is provided in second friction member 414 for receiving the distal end of first spring 440. Second spring 450 extends between first friction member 412 and second friction member 414. Aperture 452 is provided in first friction member 412 for receiving an end of second spring 450. Aperture 454 is provided in second friction member 414 for receiving the distal end of second spring 450.

Spring 440 and spring 450 normally bias first friction member 412 and second friction member 414 outwardly from inner post 402. First friction member extensions 462 and 464 and second friction member extensions 466 and 468 limit the extent of outward extension of first friction member 412 and second friction member 414.

Upon insertion of a paper roll (not shown) over inner post 402 and outer post 404, first friction member 412 and second friction member 414 are each biased against the interior of the paper roll.

A spring 430 and guide pin 436 is provided for relative movement of inner post 402 and outer post 410 for purposes of inserting and removing the paper towel holder 400 in the same manner as previously described in relation to FIG. 11.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for rotatably supporting a roll of sheet material having:

a base;

a cylindrical inner post attached at a first end to said base;

a hollow cylindrical outer post slidably extended over a second end of said inner post;

said inner post having a first friction means and a second friction means, each of said first friction means and said second friction means extending resiliently outwardly beyond the diameter of said inner post;

said first friction means comprising a first arm pivotally connected to said inner post and a spring means biasing said first arm outwardly from said inner post;

said second friction means comprising a first abutment member having a surface in resilient abutment with an inner surface of said outer post and spring means biasing said abutment member against said outer post inner surface;

said outer post slidable between a first outer post position in juxtaposition with said base and a second outer post position distal of said base, said outer post extending over said first friction means in said first outer post position, said first friction means extending outwardly beyond an outer diameter of said outer post in said second outer post position;

whereby relatively free rotation of said roll is maintained in said first outer post position, and rotation of said roll is frictionally limited by said first friction means in said second outer post position.

2. The apparatus of claim 1, said first friction means further comprising:

a second arm pivotally connected to said inner post, said spring means extending between said first and second arms, said second arm positioned on an opposite side of said inner post from said first arm.

3. The apparatus of claim 2, said second friction means further comprising:

a second abutment member having a surface in resilient contact with said outer post inner surface, said first and second abutment members received by said inner post; and a compression spring extending between said first and second abutment members within said inner post, said compression spring biasing said first and second abutment members outwardly of said inner post and against said outer post inner

4. The apparatus according to claim 1 wherein said first friction means further comprises a second arm pivotally connected to said inner post, said spring means extending between said first and second arms, said second arm positioned on an opposite side of said inner post from said first arm; and said second friction means further comprises a second abutment member having a surface in resilient contact with said outer post inner surface, said first and second abutment members received by said inner post, and a compression spring extending between said first and second abutment members within said inner post, said compression spring biasing said first and second abutment members outwardly of said inner post and against said outer post inner surface.

5. The apparatus of claim 4, said outer post having a cylindrical outer diameter, said outer post having a generally non-skid exterior surface at one closed end, said outer post having an open end extending around said inner post.

6. The apparatus of claim 4, said outer post having an outer diameter having a size suitable for receipt of the roll of detachable material.

7. The apparatus of claim 1, said base having a footing on a side opposite said inner post, said footing having means thereon for frictionally engaging a supporting surface.

8. The apparatus of claim 7, said footing means having at least one suction cup attached thereto for releasable attachment to said supporting surface.

* * * * *